US005147580A

United States Patent [19]

Hill

[11] Patent Number: 5,147,580

[45] Date of Patent: Sep. 15, 1992

[54] SELF TEMPERATURE LIMITING ELECTRICAL-CONDUCTING COMPOSITE

[76] Inventor: Robert G. Hill, Inch Abbey House, Inch Abbey Road, Downpatrick, Co. Down, Northern Ireland

[21] Appl. No.: 575,606

[22] Filed: Aug. 31, 1990

[30] Foreign Application Priority Data

Sep. 7, 1989 [GB] United Kingdom ..... 8920283

[51] Int. Cl.[5] ..... H01B 1/06

[52] U.S. Cl. ..... 252/506; 252/511; 252/518; 524/492; 524/493; 524/495; 524/496

[58] Field of Search ..... 252/511, 506, 518; 524/495, 496, 492, 493

[56] References Cited

U.S. PATENT DOCUMENTS 3,858,144 12/1974 Bedard et al. ..... 252/511

FOREIGN PATENT DOCUMENTS 0290240 4/1988 European Pat. Off. .

*Primary Examiner*—William R. Dixon, Jr.
*Assistant Examiner*—Deborah Jones
*Attorney, Agent, or Firm*—Finnegan, Henderson, Farabow, Garrett & Dunner

[57] ABSTRACT

A self temperature limiting electrical conducting composite comprising a dispersion of an electrical conducting aggregate and an electrical insulating aggregate in a polymer. The electrical conducting aggregate is preferably a natural or synthetic graphite. The electrical insulating aggregate is preferably silica ($SiO_2$) or calcite. The polymer is preferably an acrylate.

12 Claims, No Drawings

SELF TEMPERATURE LIMITING ELECTRICAL-CONDUCTING COMPOSITE

This invention relates to an electrical-conducting composite which is self-limiting in terms of temperature when used as a resistance heater in an electrical circuit. This property is sometimes known as self-regulation and in this phenomenon as the temperature of the composite element increases the element's resistance rises and the power, which is delivered as heat, falls as a consequence. At a fixed temperature, which depends on the composition of the composite, the system stabilises and the power consumed falls to a minimum with the heating element thereafter functioning at constant temperature without the requirement of a thermostat.

This property of self-regulation is important in terms of the safety of a heater system in that the thermostatic regulation is an intrinsic part of the bulk properties of the materials and does not depend upon expansions, or bimetallic flexings, in circuit adjuncts such as thermostats. Self-regulating composites are well known but all are based upon the semicrystalline polymers, such as the polyolefins, which are filled with electro-conducting particulates such as carbon black. Researchers have suggested that at ambient temperatures the carbon particles are in contact within the polymer matrix and give specific resistivities of about 1 ohm/cm; but when the composite is heated, by the passage of electrical current through it, a large volume change occurs at the point where the polymer loses its crystallinity and as this expansion is more rapid than that of the carbon black the latter particles are separated further from each other thus raising the composite's resistivity. It is reported that increases in resistivity of an order of magnitude of 1.5 to 8 are possible.

When a particulate electrical conducting filler is added to a non-conducting matrix the system undergoes a sharp transition from a non-conductor to a conductor at a critical volume per cent of filler, typically at about 7%, but such compositions are constant wattage materials and behave as conventional resistors. Further the electrical conductivity of such composites depends, to a large extent, on the type of carbon black used and its properties such as particle size, aggregate shape and particle porosity. In general the conductive filler with large surface area, that is small particle size, yields composites with higher conductivities.

Whilst conductive carbon filled polymers find use in many industrial applications they have some severe disadvantages such as lack of electrical reproducibility which is believed to be due to structural changes which take place as the composite goes through heating-cooling cycles during its use as a resistance heater.

The prior art teaches that such electrical variations can be overcome by the use of polymer mixtures which can be cross-linked and which thereafter give conduction stability by attaching carbon particles to the new cross-linked network. U.S. Pat. No. 3,858,144 discloses polyolefins which, when filled with carbon black and cross-linked with ethylene ethyl acrylate copolymer, provide a cross-linked saturated "polyolefin" which is practically thermosetting but which is stable and reproducible and which now exhibits current switching properties which are described as self regulating.

It is suggested in the prior art, and in other research papers, that it is the rapid expansion of the polymer at, or about, its glass transition point that produces the internal changes in the polymer-carbon black composite which separates dispersed carbon aggregates from each other and thereby cuts down the number of current conducting paths between the electrodes of the heater. The present state of the art is such that self-regulating properties, in terms of current carrying capacity, can only be obtained when conductive fillers, such as carbon black, are uniformly dispersed in a cross-linkable polymer mix and the system thereafter cross-linked either chemically or by radiation so that the carbon aggregates are fixed, or stabilized, in the network formed during cross-linking.

Much work has been done to exploit this property of self-regulation in the specialised industrial heating field and in all cases the materials used have consisted of cross-linked polymer filled with carbon blacks.

It would seem that the essentials of this reported technology is the requirement of a cross-linked polymer with a suitable glass transition temperature and a conductive filler like carbon black.

It is an object of the present invention to provide an improved self temperature limiting electro-conductive composite.

The invention, therefore, provides a self temperature limiting electrical conducting composite comprising a dispersion of an electrically conducting aggregate and an electrical insulating aggregate in a polymer.

In the invention herein to be described it can be recorded that it is possible to produce stable, reproducible composites which act as self regulating conductors and which do so without the requirements of co-polymerisation or cross-linking.

The research leading to this invention indicates that carbon in the form of carbon blacks or graphite is not dispersed in polymers as discrete particles but rather as aggregates and it is these aggregates which form the conducting pathways through the polymer. Also it is these that are disrupted during the polymer matrix expansion, which provides the mechanism by which the positive temperature coefficient of resistance (PTC) is obtained in the self-regulating composites.

The invention also provides a method of making a self temperature limiting electrical conducting composite which comprises the steps of mixing together an electrical conducting aggregate; an electrical insulating aggregate; a monomer; and a curing agent; subjecting the monomer to polymerisation and allowing the resulting mixture to cure.

For optimum results, the electrical insulating aggregate used should preferably have specific physical properties. For instance, if very fine particle sized aggregates such as chalk (whiting), quarry dust or microcrystalline inorganic salts like soda ash or magnesium oxide are used they simply homogeneously blend with the carbon black or graphite and the result is a composite having poor conductivity not unlike polymer concrete which has been coloured black with carbon.

It has also been established that there is an optimum particle size range for the electrical insulating aggregates. Generally speaking the aggregate particles should be about 2.5 mm or less. Preferably, the particle size ranges are 0.03 to 0.3 mm; or 0.3 to 0.8 mm or 1.6 to 2.5 mm.

In addition to these size parameters there is also a way by which the self-regulating effect can be enhanced, or optimized, and that is to select the electrical insulating aggregate which is derived from the natural or man-made fragmentation of crystalline materials especially those crystals which have two different coefficients of linear expansion. For example, silica or quartz ($SiO_2$), which has coefficient of linear expansion values of $8\times10^{-6}$ and $13\times10^{-6}$ expressed as the increase in length per unit length (measured at 0° C.) per °C. and depending on whether the measurement is made parallel or perpendicular to the crystal axis and calcite ($CaCO_3$) which has values of $25\times10^{-6}$ and $6\times10^{-6}$ may be used.

Natural quartz sands are available in the previously mentioned particle size ranges from the Dorfner Company of West Germany. One particular silica is sold under the trade name "Geba" and has the property of rounded edges. Another similar type of silica is sold under the trade name "Siligran" available from the West Deutsche Quarzwerke of Dr. Muller Ltd., Dorsten, West Germany.

It is well known that when spheres are packed as closely as possible they occupy a solid volume which is 74.06% of the total vessel volume which means that in this type of orientation the interstitial voids occupy 25.94% of the total apparent volume. With spheres or spheroids of varying diameter this type of close packing can only come from long term natural particle attrition and it is believed that much of the success of these described self-regulation formulation is due to the degree of natural close packing achieved with silica in the described sands. For example the following grades from Dorfner viz. 5G (1.6 to 2.5 mm); N8 (0.3 to 0.8 mm) and "Geba" (0.03 to 0.3 mm) all have interstitial void volumes of 26.9%, 28.4% and 29.1% respectively which are close to the theoretical figure of 25.94%.

It has been found that the best grading for the electrically conductive aggregate is graphite in the range of 50 to 75 microns and both natural and synthetic varieties are suitable. Examples are Grade 9490 from Bramwell & Co. at Epping, Essex with a minimum carbon content of 85% or from the same company Luxara (trade name) No. 1 with a minimum carbon content of 95% and a nominal size of 53 microns. Many carbon blacks are also suitable for embodiments of this invention and a useful one is No. 285RC25 from James Durrans of Sheffield which has a minimum carbon content of 80% and a nominal size of 53 microns. The ash content of the graphite should preferably be 15% or less by weight.

The invention is further illustrated by the following examples:

EXAMPLE 1

| EXAMPLE 1 | |
|---|---|
| Silica Sand | 55.5% |
| Graphite | 15.0% |
| Methylmethacrylate Monomer | 28.0% |
| Benzoyl Peroxide (50%) Lucidol (TM) | 1.5% |

All quantities are quoted in terms of percentage weight for weight (% w/w).

The method of manufacture entails mixing the silica, graphite and benzoyl peroxide together in order to obtain a homogeneous powder which is then gently gauged into a paste with the acrylic monomer. Care should be taken not to entrain air and it is useful to further deaerate the final mix, before polymerization proceeds very far, by the use of either a consolidating vibration table or a vacuum degassing chamber. After mixing the temperature rises, because of the exothermic reaction, and polymerization is complete within half an hour if the materials are initially at ambient temperature.

The resulting composite is self-regulating as can be seen from the following electrical data, which is reproducible and constant even after much thermal recycling.

| | |
|---|---|
| Cold Resistance (19° C.) | 470 ohms |
| Volts A.C. Applied | 220 r.m.s. |
| Power Dissipated at Start | 114 watts |
| Initial Temperature | 19° C. |
| Power at Regulation | 42 watts |
| Temperature at Regulation | 165° C. |
| Duration of Test | 19 mins. |

In this example the silica used had a grade range of 0.06 mm to 0.30 mm, the graphite was natural material with a size range of 50 to 75 microns and the monomer was a liquid methyl methacrylate sold by Degussa Limited of West Germany under the (trade name) Degament 1340. Almost any type of methyl methacrylate monomer is suitable for use in this invention, as are other liquid monomer systems like polyesters and epoxys, but the preferred ones are the acrylics and a whole range is available from many different manufacturers.

EXAMPLE 2

| EXAMPLE 2 | |
|---|---|
| Silica Sand | 57% |
| Graphite | 17% |
| Methyl Methacrylate Monomer | 23.5% |
| Benzoyl Peroxide (50%) Lucidol (TM) | 2.5% |

All the quantities quoted were measured on a weight for weight percentage basis and the mixing procedure was identical to that employed in Example 1. The electrical properties of the prepared composite were as follows:

| | |
|---|---|
| Cold Resistance (22° C.) | 1,000 ohms |
| Volts A.C. Used | 229 r.m.s. |
| Power Dissipated at Start | 164 watts |
| Initial Temperature | 22° C. |
| Power at Regulation | 89 watts |
| Temperature at Regulation | 90° C. |

The type and source of raw materials used in this example were the same as those already described in Example 1. The benzoyl peroxide used in both examples is 50% strength and is sold under the trade name Lucidol. It is pure benzoyl peroxide diluted for safe handling purposes with 50% of dicyclohexyl phthalate.

In the present invention and contrasting with the teaching of the prior art, it is not necessary to select polymeric materials which can cross-link to materials resembling thermosetting plastic; and neither is it necessary to depend upon the volumetric transitions which occur at the polymer's glass transition temperature. In the examples the monomer selected is from the methyl methacrylate range with glass transition temperatures of 105° C. which in many cases is much higher than the regulation temperatures achieved.

In European Patent Specification No. EP-A-0 290 240 there is disclosed the use of silica loaded acrylic, and similar polymeric materials, in the form of polymer cements or concretes. The composite is an extremely good electrical insulator but because it is so highly loaded with mineral matter, especially silica sands, it has the unusual property of being a useful heat conductor, a combination which does not occur in nature.

In the same European Patent Specification there is disclosed the use of the composites to clad or encapsulate bare electrical resistance elements and examples are given of panel heaters and the like which are produced from the cements. It has been found that the self temperature limiting electro-conductive composites of the present invention can be encapsulated in accordance with the teaching of the above identified European Patent Specification either in the form of rod shaped extrusions or sheets. The composites can be applied, or extruded upon, a half thickness of polymer concrete and then finally encapsulated by another half thickness topping of polymer concrete This gives a non-metallic resistance heater which is self-regulating without the use of a thermostat and is unknown in the prior art. Accordingly, an electric heating device could be produced which comprises a composite according to the present invention encased in a polymer cement block comprising between 75% and 95% by weight of an inorganic or mineral material having a particle size of between 0.005 mm and 20 mm and between 5% and 25% of a cured polymer or plastics material; and means for making an electrical connection externally of the block to the composite.

Although it is not a requirement of this invention to postulate the physical mechanism by which the self-regulatory process operates in the described composites an attempt will aid understanding and help to distinguish it from the theories of the prior art. It is believed that the use of fragmented silicas (quartz) in a good close packed configuration gives the necessary expansion separations within the polymer matrix to enable the aggregates of graphite or carbon black to move apart and thus reduce the number of conductive pathways in the composite between its built-in electrodes.

By the process of table vibration the various silica particles will close pack as far as possible and in this configuration their original crystal axes will not be in alignment, because such a distribution would be non-statistical, so when expansion occurs the differential movement of the quartz, which depends on the axis orientation, will give in some directions a reduced expansion and in others a reinforced expansion. It is this reinforcement of expansion which separates adjacent silica particles from each other and thus breaks the graphite, or carbon black, aggregates apart and thereby reducing the conductive paths leading to the phenomenon of self-regulation. The vibration should preferably be carried out at a frequency of 25 Hz or greater.

Such conductive composites as have been described herein behave, of course, as bare conductors under full mains voltages, and are, as stated earlier, particularly useful for use in the disclosure in the above mentioned European Patent Specification. Otherwise the industrial exploitation would have to depend upon the existing technology of insulation and metal cladding or insulation by polymer coatings or polymer extrusion covers.

The invention is not limited by or to the specific embodiments described which can undergo considerable variation without departing from the scope of the invention.

I claim:

1. A self temperature limiting electrical conducting composite comprising a dispersion of an electrical conducting aggregate having a particle size in the range of from 50 to 75 microns and an electrical insulating aggregate having a particle size in the range of from 0.03 mm to 2.5 mm in a polymer matrix of an ester of methacrylic acid.

2. A composite as claimed in claim 1, wherein the electrical conducting aggregate is a natural graphite.

3. A composite as claimed in claim 1, wherein the electrical conducting aggregate is a synthetic graphite.

4. A composite as claimed in claim 1, wherein the electrical conducting aggregate is silica.

5. A composite as claimed in claim 1, wherein the electrical conducting aggregate is calcite.

6. A composite as claimed in claim 2, wherein the graphite aggregate has an ash content of up to 15% by weight.

7. A composite as claimed in claim 3, wherein the graphite aggregate has an ash content of up to 15% by weight.

8. A composite as claimed in claim 1, wherein the electrical conducting aggregate is silica having a particle size within the range 0.03 mm to 0.30 mm.

9. A composite as claimed in claim 1, wherein the electrical conducting aggregate is calcite having a particle size within the range of 0.3 mm to 0.8 mm.

10. A composite as claimed in claim 1, wherein the electrical conducting aggregate is silica having a particle size within the range 1.6 mm to 2.5 mm.

11. A composite as claimed in claim 1, wherein the polymer is a polyalkylmethacrylate.

12. A composite as claimed in claim 11, wherein the polymer is a polymethylmethacrylate.

* * * * *